US010408029B2

(12) United States Patent
Rodrigues et al.

(10) Patent No.: US 10,408,029 B2
(45) Date of Patent: Sep. 10, 2019

(54) OPTIMIZING HYDRAULIC FRACTURING IN A SUBTERRANEAN FORMATION

(71) Applicant: Halliburton Energy Services, Inc., Houston, TX (US)

(72) Inventors: Elias Da Conceição Rodrigues, Rio de Janeiro (BR); Flávio Henrique Marchesini, Rio de Janeiro (BR); Rafael Menezes Oliveira, Rio de Janeiro (BR)

(73) Assignee: Halliburton Energy Services, Inc., Houston, TX (US)

( * ) Notice: Subject to any disclaimer, the term of this patent is extended or adjusted under 35 U.S.C. 154(b) by 270 days.

(21) Appl. No.: 15/519,476

(22) PCT Filed: Nov. 24, 2014

(86) PCT No.: PCT/US2014/067147
§ 371 (c)(1),
(2) Date: Apr. 14, 2017

(87) PCT Pub. No.: WO2016/085454
PCT Pub. Date: Jun. 2, 2016

(65) Prior Publication Data
US 2017/0241251 A1 Aug. 24, 2017

(51) Int. Cl.
*E21B 43/26* (2006.01)
*E21B 41/00* (2006.01)
(Continued)

(52) U.S. Cl.
CPC ..... *E21B 43/26* (2013.01); *E21B 41/0092* (2013.01); *E21B 43/267* (2013.01); *E21B 47/06* (2013.01); *E21B 49/00* (2013.01)

(58) Field of Classification Search
CPC .... E21B 41/0092; E21B 43/26; E21B 43/267; E21B 47/06; E21B 49/00
See application file for complete search history.

(56) References Cited

U.S. PATENT DOCUMENTS 5,482,116 A * 1/1996 El-Rabaa ..... E21B 43/26 166/250.1
2009/0205819 A1* 8/2009 Dale ..... E21B 41/00 166/250.01

(Continued)

FOREIGN PATENT DOCUMENTS

WO 2014/070503 A1 5/2014

OTHER PUBLICATIONS

International Preliminary Report on Patentability issued in related Application No. PCT/US2014/067147, dated Jun. 8, 2017 (12 pages).

(Continued)

*Primary Examiner* — James G Sayre
(74) *Attorney, Agent, or Firm* — John Wustenberg; Baker Botts L.L.P.

(57) ABSTRACT

In one embodiment, a method is disclosed for optimizing hydraulic fracturing in a subterranean formation having at least one perforation coupled to a wellbore. For each of a number of points along the at least one perforation, the pressure of a fracturing fluid is calculated based on a first pressure and a time-dependent rheological model that includes at least one of elasticity, viscoplasticity, and structural development of the fracturing fluid. A ratio of the pressure of the fracturing fluid to a fracture stress of the at least one perforation is calculated. When the ratio is greater than one, inject the fracturing fluid, at the first pressure, into the wellbore and through the at least one perforation, creating pressure-induced fractures in the perforation.

20 Claims, 5 Drawing Sheets

(51) Int. Cl.

| | |
|---|---|
| ***E21B 43/267*** | (2006.01) |
| ***E21B 47/06*** | (2012.01) |
| ***E21B 49/00*** | (2006.01) |

(56) References Cited

U.S. PATENT DOCUMENTS

| | | | | |
|---|---|---|---|---|
| 2010/0218941 | A1 | 9/2010 | Ramurthy et al. | |
| 2010/0224365 | A1* | 9/2010 | Abad | E21B 43/26 166/275 |
| 2010/0299111 | A1* | 11/2010 | Dale | E21B 47/00 703/2 |
| 2011/0125471 | A1 | 5/2011 | Craig et al. | |
| 2013/0124171 | A1* | 5/2013 | Schuette | G06F 17/5009 703/2 |
| 2014/0027112 | A1 | 1/2014 | Irani et al. | |
| 2014/0262232 | A1 | 9/2014 | Dusterhoft et al. | |
| 2015/0032425 | A1* | 1/2015 | Kulkarni | G06F 17/5009 703/2 |
| 2015/0066455 | A1* | 3/2015 | Madasu | E21B 43/267 703/2 |

OTHER PUBLICATIONS

De Souza Mendes, Paulo R. "Thixotropic elasto-viscoplastic model for structured fluids." Soft Matter 7.6 (2011): 2471-2483.

De Souza Mendes, Paulo R., and Roney L Thompson. "A unified approach to model elasto-viscoplastic thixotropic yield-stress materials and apparent yield-stress fluids." Rheologica Acta 52.7 (2013): 673-694.

International Search Report and Written Opinion issued in related PCT Application No. PCT/US2014/067147 dated Aug. 21, 2015, 15 pages.

* cited by examiner

OPTIMIZING HYDRAULIC FRACTURING IN A SUBTERRANEAN FORMATION

CROSS-REFERENCE TO RELATED APPLICATION

The present application is a U.S. National Stage Application of International Application No. PCT/US2014/067147 filed Nov. 24, 2014, which is incorporated herein by reference in its entirety for all purposes.

BACKGROUND

Hydraulic fracturing enhances hydrocarbon production by injecting a fluid into a subsurface formation. Fractures created by the injected fluid allow hydrocarbons to flow from the reservoir to the wellbore. Companies spend significant resources developing fracturing fluids and pumping these fluids into the subsurface formations.

BRIEF DESCRIPTION OF THE DRAWINGS

These drawings illustrate certain aspects of certain embodiments of the present disclosure. They should not be used to limit or define the disclosure.

Although embodiments of this disclosure have been depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION OF EXAMPLE EMBODIMENTS

The present disclosure relates to wellbore operations, and, more particularly, to methods and non-transitory media for optimizing hydraulic fracturing in a subterranean formation. Specifically, the embodiments herein relate to optimizing fracturing fluids to minimize pumping energy requirements. This may be achieved using mass and momentum balance equations coupled to a time-dependent rheological model to predict the pressure evolution of the fracturing fluid at points along a wellbore and through perforations.

To facilitate a better understanding of the present disclosure, the following examples of certain embodiments are given. In no way should the following examples be read to limit, or define, the scope of the disclosure. Embodiments of the present disclosure and its advantages are best understood by referring to FIGS. 1 through 5, where like numbers are used to indicate like and corresponding parts.

Figure 1:
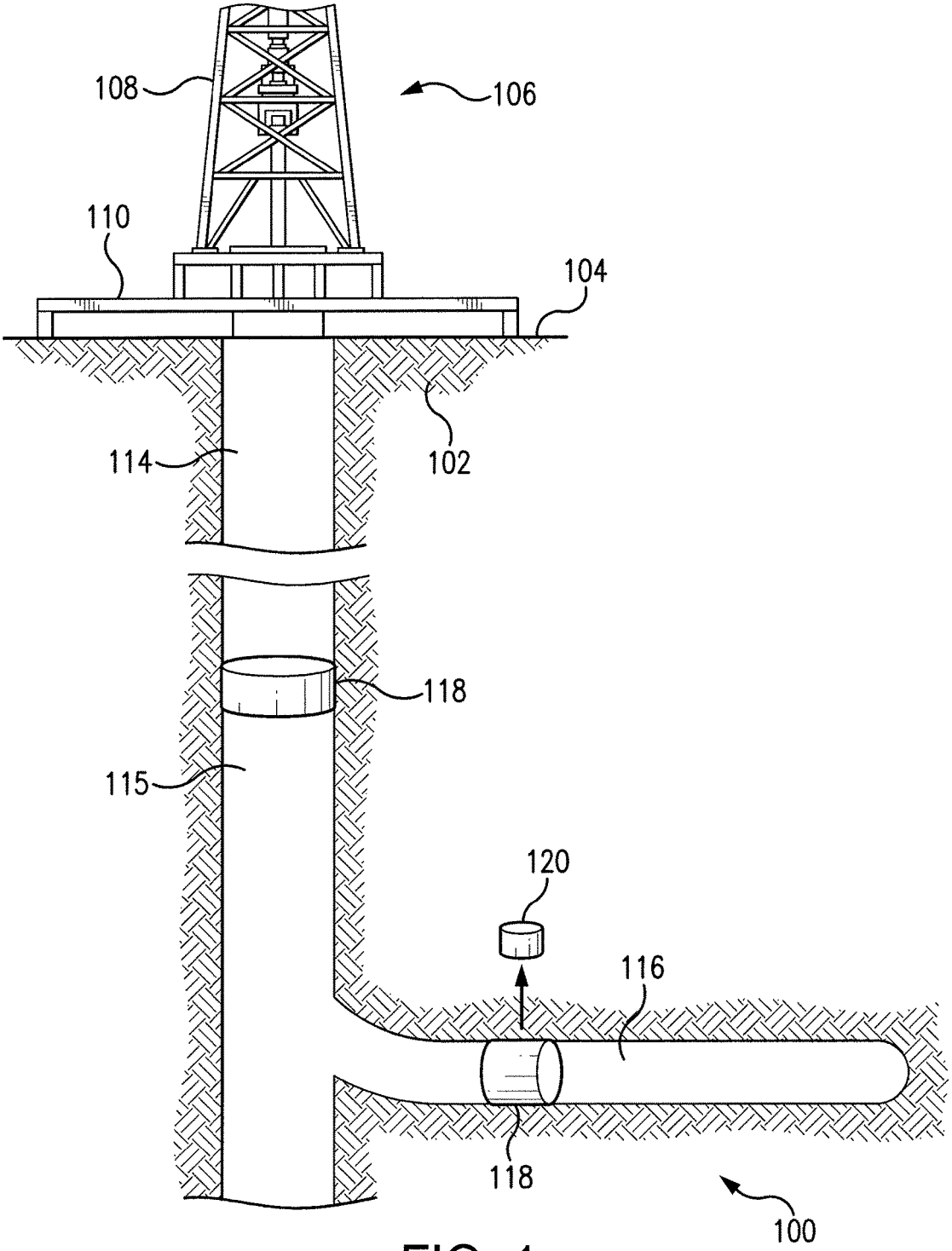
FIG. 1 illustrates a wellbore penetrating a subterranean formation.

FIG. 1 illustrates an example hydraulic fracturing setup 100. A drilling rig 106 comprises a derrick 108 and a rig floor 110, which are located on a surface 104.

A wellbore 114, penetrates a subterranean formation 102 using any necessary drilling technique. Wellbore 114 may extend vertically away from surface 104 over a vertical wellbore section 115. Vertical wellbore section 115 may extend as far as necessary to recover hydrocarbons from subterranean formation 102. Although the illustrated embodiment shows vertical wellbore section 115 extending straight down through subterranean formation 102, wellbore 114 and vertical wellbore section 115 may deviate at any angle from surface 104. A perforation section 116 extends from vertical wellbore section 115. In certain embodiments, multiple perforation sections 116 may extend from vertical wellbore portion 115. Although perforation section 116 is shown extending parallel to surface 104, perforation section 116 may deviate at any angle from vertical wellbore portion 115, and may not be parallel to surface 104.

In an example embodiment, a fracturing fluid 118 is injected into wellbore 114, travels through vertical wellbore portion 115, and flows into perforation section 116, wherein fracturing fluid 118 creates pressure-induced fractures in perforation region 116. As fracturing fluid 118 flows through perforation section 116, a portion of fracturing fluid 118 may leak into perforation section 116, resulting in a filtrate 120.

In certain embodiments, fracturing fluid 118 may represent one or more fluids used in the hydraulic fracturing process. For example, fracturing fluid 118 may represent a prepad acid mixture used to clear cement debris in wellbore 114 and provide a clear path to perforation section 116. In another embodiment, fracturing fluid 118 represents a slickwater pad solution that aids the flow and placement of later fracturing fluids 118. As another example, fracturing fluid 118 may contain proppant, such as sand, to maintain the pressure-induced fractures created during the hydraulic fracturing process.

Fracturing fluid 118 exhibits rheological properties, which affect how fracturing fluid 118 behaves in subterranean formation 102. In certain embodiments, fracturing fluid 118 may have one or more additives to aid in the fracturing process. For example, fracturing fluid 118 may contain one or more of the following non-limiting additives: acids, breakers, bactericides, adjusting agents, crosslinking polymer agents (e.g., borate crosslinked gel fluids), friction reducers, gelling agents, solvents, and surfactants. The type of additive used in fracturing fluid 118 will depend on a variety of factors such as the composition of subterranean formation 102 and the previous fluids added to wellbore 114.

Although the illustrated embodiment refers to drilling rig 106 stationed on surface 104, those skilled in the art will recognize that drilling rig 106 may be stationed on other environments such as an offshore drilling rig.

According to the teachings of the disclosure, the embodiments herein may be used to produce an optimized fracturing fluid by calculating a ratio of the pressure of the fracturing fluid to a stress of a perforation in a subterranean formation. As used herein, "ratio" refers to the ratio between the pressure of the fracturing fluid to the stress of the perforation at points along the subterranean formation. The ratio may be used to determine whether the fracturing fluid's pressure evolution in time at points along a wellbore and through perforations is sufficient to create pressure-induced fractures at points along the perforation. The embodiments described herein may take into account one or more properties of the subterranean formation and one or more properties of a fracturing fluid. Depending on the particular application, certain properties may be more relevant for optimizing the fracturing fluid in order to obtain a desired ratio. What fracturing fluid characteristics to manipulate may depend on the particular application and subterranean formation.

Certain embodiments may provide one or more technical advantages. A technical advantage of one embodiment may minimize the pumping energy required to inject fracturing fluids into a wellbore and through a perforation, thereby reducing costs in the fracturing process. Certain embodiments may also reduce the volume of fracturing fluid required to create pressure-induced fractures in the subterranean reservoir. As another example, some embodiments will alleviate the use of a trial-and-error method to design fracturing fluids that provide the required fracturing pressure at points throughout a perforation. Other embodiments may provide a way to evaluate the pressure rate at the top of the well, which can improve the overall safety of the operation. By optimizing the fluids used in the fracturing process, the hydraulic fracturing job may reduce costs, provide a more efficient operating time, and increase safety. One or more other technical advantages may be readily apparent to one skilled in the art from the figures, descriptions, and claims included herein.

Currently existing pressure predictions fail to take into account visco-elastic effects and time-dependent rheology of the fracturing fluid. The oversimplification of existing pressure predictions is especially noticeable when cross-linked polymer fluids and high proppant concentrations are used. Certain embodiments of the present disclosure may provide a better predicative analysis of the complex fracturing fluids used during a hydraulic fracturing process. For example, a more efficient hydraulic fracturing system may be realized by optimizing a fracturing fluid according to visco-elastic, time-dependent rheology models. Certain embodiments of the disclosure may include none, some, or all of the above technical advantages. One or more other technical advantages may be readily apparent to one skilled in the art from the figures, descriptions, and claims included herein.

Figure 2:
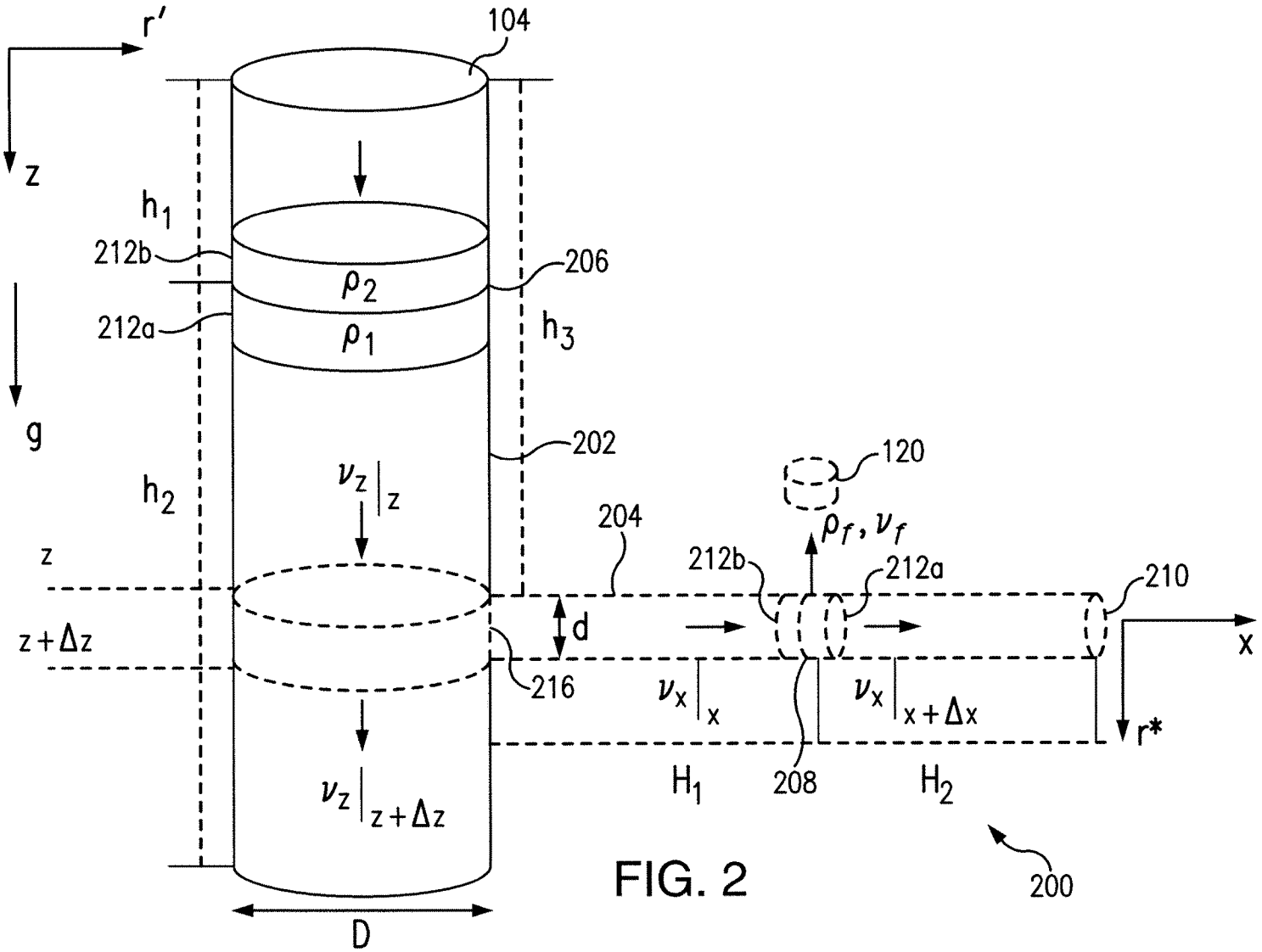
FIG. 2 illustrates a mathematical representation of a wellbore penetrating a subterranean formation.

FIG. 2 illustrates a schematic representation 200 of hydraulic fracturing setup 100 of FIG. 1. Wellbore 114, vertical wellbore portion 115, and perforation section 116 are modeled as cylinders to predict the behavior of fracturing fluid 118 in subterranean formation 102. For simplicity of illustration, schematic representation 200 is illustrated using two main sections: a wellbore cylinder 202 and a perforation cylinder 204. Wellbore cylinder 202 represents wellbore 114 and vertical wellbore portion 115, whereas perforation cylinder 204 represents perforation section 116 of hydraulic fracturing setup 100.

A number of coordinates and variables describe the physical characteristics of schematic representation 200. Wellbore cylinder 202 has coordinates z and r', wherein z represents the axial direction and r' represents the radial direction of wellbore cylinder 202. Variable g, is the gravitation acceleration in the z direction. Variable $h_1$ represents the distance from surface 104 (z=0) to a wellbore interface 206. Variable $h_2$ represents the distance from wellbore interface 206 to the bottom of wellbore cylinder 202. Wellbore interface 206 represents the location, in the z direction, of fracturing fluid 118 in wellbore cylinder 202. Variable $h_3$ represents the depth of perforation cylinder 204, measured from surface 104. Wellbore cylinder 202 has diameter, D, which may vary along the depth of wellbore cylinder 202. In certain embodiments, diameter, D, varies according the diameter of the different casings used in wellbore 114 and vertical wellbore portion 115.

Perforation cylinder 204 has coordinates x and r*, wherein x represents the axial direction and r* represents the radial direction of perforation cylinder 204. Variable $H_1$ represents the distance from a perforation opening 216 to a perforation interface 208. Perforation opening 216 (x=0) represents the beginning of perforation cylinder 204. Variable $H_2$ represents the distance from perforation interface 208 to the end of perforation cylinder 204. Perforation interface 208 represents the location, in the x direction, of fracturing fluid 118 in perforation cylinder 204. Filtrate 120 represents the portion of fracturing fluid 118 lost to perforation section 116. Perforation cylinder 204 has diameter, d, and may vary along the axis of perforation cylinder 204.

In the illustrated embodiment, schematic representation 200 includes a fracturing fluid 212*a* and a fracturing fluid 212*b*. In certain embodiments, the use of multiple fracturing fluids may lead to a more efficient hydraulic fracturing process. For example, fracturing fluid 212*a* may be an acidic prepad solution, while fracturing fluid 212*b* may contain proppant. As another example, fracturing fluid 212*a* is a pad solution containing a friction-reducing additive, while fracturing fluid 212*b* contains a viscosifier. Due to the variances in composition, fracturing fluid 212*a* may have a first density, $\rho_1$, while fracturing fluid 212*b* may have a second density, $\rho_2$. The composition of fracturing fluids 212*a* and 212*b* will affect how the respective densities change with temperature and pressure. Although schematic representation 200 shows fracturing fluid 212*a* and fracturing fluid 212*b*, one or more fracturing fluids may be used during the hydraulic fracturing process. Furthermore, although schematic representation 200 shows fracturing fluids 212*a* and 212*b* in wellbore cylinder 202 at the same time, fracturing fluid 212*a* and fracturing fluid 212*b* may be injected into wellbore 114 at different times and at different pumping energies.

Schematic representation 200 may aid in understanding the mechanics of fracturing fluid 212*a* and fracturing fluid 212*b* as they flow through wellbore 114, vertical wellbore section 115, and perforation section 116. In certain embodiments, fracturing fluid 212*a* is injected at a first pressure into wellbore 114 at surface 104. Fracturing fluid 212*a* travels through wellbore cylinder 202 with velocity, $v_{1_z}$, in the z direction. Fracturing fluid 212*a* travels down wellbore cylinder 202 and into perforation cylinder 204. Fracturing fluid 212*a* travels through perforation cylinder 204 with velocity, $v_{1_x}$, in the x direction. After fracturing fluid 212*a* is injected into wellbore 114, fracturing fluid 212*b* may be injected into wellbore 114 at surface 104. Fracturing fluid 212*b* travels through wellbore cylinder 202 with velocity, $v_{2_z}$, in the z direction. Fracturing fluid 212*b* travels down wellbore cylinder and into perforation cylinder 204. Fracturing fluid 212*b* travels through perforation cylinder 204 with velocity, $v_{2_x}$, in the x direction. While traveling through perforation cylinder 204, a non-trivial amount of fracturing fluid 212*a* and 212*b* may be lost to the perforations resulting in filtrate 120. Filtrate 120 has velocity, $v_f$.

In certain embodiments, a ratio is calculated to determine whether the pressure of fracturing fluid 118, at points along perforation section 116, is sufficient to create pressure-induced fractures. The ratio describes the potential for fracturing fluid 118 to create pressure-induced fractures at a point along perforation section 116. Use of the term "at a point" may represent a particular point along perforation section 116, the entire length of perforation section 116, or a plurality of points along perforation section 116. The ratio may be a dimensionless figure calculated as a function of time at a point along perforation section 116. To calculate the ratio, two quantities are needed: the fracture stress of perforation section 116 and the pressure of fracturing fluid 118 at a point along perforation section 116. In certain embodiments, the ratio is calculated according to equation (1):

$$P^* = \frac{P}{\sigma_{frac}} \tag{1}$$

Wherein:

P* is the ratio;

P is the pressure of fracturing fluid 118 at a point along perforation section 116; and $\sigma_{frac}$ is the stress of perforation section 116.

In certain embodiments, the stress of the perforation section 116 is calculated from field evaluations made before the design of a hydraulic fracturing job. The fracturing stress may be determined based on subterranean formation 102 through which wellbore 114 and vertical wellbore portion 115 extend and couple to perforation section 116. The formation properties suitable for use in determining the pressure ratio may include, but are not limited to, permeability, capillary pressure, swelling capacity, stress, well dimensions, and density. The fracturing stress for use in equation (1) may be obtained by any known method in the industry.

In certain embodiments, the pressure, P, of fracturing fluid 118 is calculated at points along perforation section 116. Schematic representation 200 may be used to calculate the pressure of fracturing fluid 118 at points along wellbore cylinder 202 and perforation cylinder 204. In some embodiments, the pressure of fracturing fluid 118 is calculated according to a mass balance model, a momentum balance model, and a time-dependent rheology model. As described in greater detail below, a mass balance equation accounts for fracturing fluid 118 as it enters and leaves wellbore cylinder 202 and perforation cylinder 204. A momentum balance equation describes the direction and magnitude of the flow of fracturing fluid 118 through wellbore cylinder 202 and perforation cylinder 204. A time-dependent rheology model may take into account the elasticity, viscoplasticity, structural development, and changes to the mechanical behavior of fracturing fluid 118 at points along wellbore 114 and perforation section 116. For ease of explanation, the following non-limiting mass and momentum equations are described in one-dimension, but the equations may be derived in one, two, or three dimensions.

In an example embodiment, mass and momentum balance equations calculate the pressure of fracturing fluids 212*a* and 212*b* at points along wellbore cylinder 202 and perforation cylinder 204. To accurately calculate the behavior of fracturing fluids 212*a* and 212*b*, mass and momentum balance equations are derived for both wellbore cylinder 202 and perforation cylinder 204. In an example embodiment, the mass and momentum balance equations shown in equations (2) and (3), respectively, may be used to describe fracturing fluids 212*a* and 212*b* through wellbore cylinder 202:

$$\frac{\partial \rho_i}{\partial t} + \frac{\partial(\rho_i v_{i_z})}{\partial z} = -\frac{4\rho_i v_{i_{x0}}}{D},\ i = 1, 2 \tag{2}$$

$$\rho_i\left(\frac{\partial v_{i_z}}{\partial t} + v_{i_z}\frac{\partial v_{i_z}}{\partial z}\right) = -\frac{\partial P_{i_z}}{\partial z} + \frac{\partial \tau_{i_{zz}}}{\partial z} + \frac{4\tau_{i_{r'z}}}{D} + \rho_i g_z,\ i = 1, 2 \tag{3}$$

Wherein:

i identifies the fracturing fluid (i=1 is fracturing fluid 212*a*; i=2 is fracturing fluid 212*b*);

$\rho_i$ is the density of the respective fracturing fluid 118;

$v_{i_z}$ is the velocity of the respective fracturing fluid 118 in wellbore cylinder 202;

$v_{i_{x0}}$ is the axial velocity of the respective fracturing fluid 118 at perforation opening 216;

$\tau_i$ is the shear and normal stresses of the respective fracturing fluid 118 in wellbore cylinder 202; and $P_{i_z}$ is the pressure of respective fracturing fluid 118 at a point in wellbore cylinder 202.

Boundary equations (4), (5), and (6) are used to solve mass balance equation (2) and momentum balance equation (3):

At z=0

$$\frac{\partial v_{i_z}}{\partial z} = 0;\ P = P_0 \tag{4}$$

At interface $z=h_1$ $$v_{1_z}=v_{2_z};\tau_{1_{r'z}}=\tau_{2_{r'z}};\tau_{zz}=\tau_{zz};P_{1_z}=P_{2_z} \tag{5}$$

At well bottom $z=h_1+h_2$ $$v_{i_z}=0 \tag{6}$$

Equation (4) includes variable $P_0$. The pressure of fracturing fluid 118 at surface 104 is equal to a first pressure, $P_0$, of fracturing fluid 118. This first pressure may be determined and manipulated based in part on the pumping energy used to inject fracturing fluid 118 into wellbore 114.

The results of the mass and momentum balance equations for wellbore cylinder 202 are used to calculate the mass and momentum balance equations of fracturing fluids 212*a* and 212*b* through perforation cylinder 204. In this manner, the mass and momentum balance equations for wellbore cylinder 202 and perforation cylinder 204 are coupled. Equations (7) and (8) may be used to calculate the mass and momentum balance equations, respectively, for fracturing fluids 212*a* and 212*b* through perforation cylinder 204:

$$\frac{\partial \rho_i}{\partial t} + \frac{\partial(\rho_i v_{i_x})}{\partial x} = -\frac{4\rho_f v_f}{D},\ i = 1, 2 \tag{7}$$

$$\rho_i\left(\frac{\partial v_{i_x}}{\partial t} + v_{i_x}\frac{\partial v_{i_x}}{\partial x}\right) = -\frac{\partial P_{i_x}}{\partial x} + \frac{\partial \tau_{i_{xx}}}{\partial x} + \frac{4\tau_{i_{r^*x}}}{D},\ i = 1, 2 \tag{8}$$

Wherein:

$\rho_f$ is the density of filtrate 120 lost to perforation section 204;

$v_f$ is the velocity of filtrate 120 lost to perforation section 204;

$\tau_i$ is the shear and normal stresses of the respective fracturing fluid 118 in wellbore cylinder 202; and $P_{i_x}$ is the pressure of the respective fracturing fluid 118 at a point along perforation cylinder 204.

Boundary equations (9), (10), and (11) are used to solve mass balance equation (7) and momentum balance equation (8):

At x=0

$$v_{i_{xo}}=v_{i_z};P_{i_x}=P_{i_z} \tag{9}$$

At interface $x=H_1$;

$$v_{1_x}=v_{2_x};\tau_{1_{r^*x}}=\tau_{2_{r^*x}};\tau_{1_{xx}}=\tau_{2_{xx}};P_{1x}=P_{2x} \tag{10}$$

At $x=H_1+H_2$ $$V_{i_x}=0 \tag{11}$$

The initial velocity, $v_{i_{xo}}$, of fracturing fluid 118 at perforation opening 216 is needed to begin solving the mass and momentum balance equations (2) and (3), respectively, for wellbore cylinder 202. Initial velocity $v_{i_{xo}}$ may be calculated using equation (12):

$$\beta_i|_{z=0}, v_{i_z}|_{z=0}, rA_v=\beta_i|_{z=h_3}, v_{i_{xo}}|_{z=h_3}, rA_p, i=1,2 \tag{12}$$

Wherein:

$A_v$ is the cross-sectional area of wellbore cylinder 202; and $A_r$ is the cross-sectional area of perforation cylinder 204.

The compressibility of fracturing fluids 212*a* and 212*b* may be modeled using the slightly compressible material hypothesis. Using this model, the density of fracturing fluids 212*a* and 212*b* can be described as a function of pressure using equation (13):

$$\rho_i = \frac{\rho_0}{1-\beta[P_i(z,t)-P(z,t=0)]} \quad i=1,2 \tag{13}$$

Wherein:

$\beta$ is the compressibility factor;

$\rho_0$ is the initial hydrostatic density profile of the respective fracturing fluid 118; and P(z, t=0) is an initial pressure profile of fracturing fluid 118 on top of wellbore 114 at surface 104;

By coupling the mass and momentum balance equations of wellbore cylinder 202 to the mass and momentum balance equations of perforation cylinder 204, the behavior of fracturing fluid 118 through wellbore 114, vertical wellbore portion 115 and perforation section 116 during the hydraulic fracturing process may be better understood. For each desired time step in the mass and momentum balance equations, the results of equations (2) and (3) are entered into equations (7) and (8). The equations may be solved in a number of ways, including but not limited to finite element, finite difference, or other discretization methods.

In certain embodiments the behavior of fracturing fluid 118 is more accurately calculated by describing the shear and normal stresses of fracturing fluid 118 as it flows through wellbore 114, vertical wellbore portion 115, and perforation section 116. In some embodiments, the shear and normal stresses used in momentum equations (3) and (8) may be calculated using a time-dependent rheological model.

A time-dependent rheological model may take into account a plurality of properties associated with fracturing fluid 118. Non-limiting examples of the rheological properties of fracturing fluid 118 may include the fracturing fluid's: shear stress; relaxation time; retardation time; viscosity; structural shear modulus; structural viscosity; steady shear flow; steady-state viscosity; consistency index; power law index; static yield stress; dynamic yield stress; steady-state viscosity of an unstructured state; stead-state viscosity of a structured state; equilibrium time; and any combinations thereof.

Figure 3:
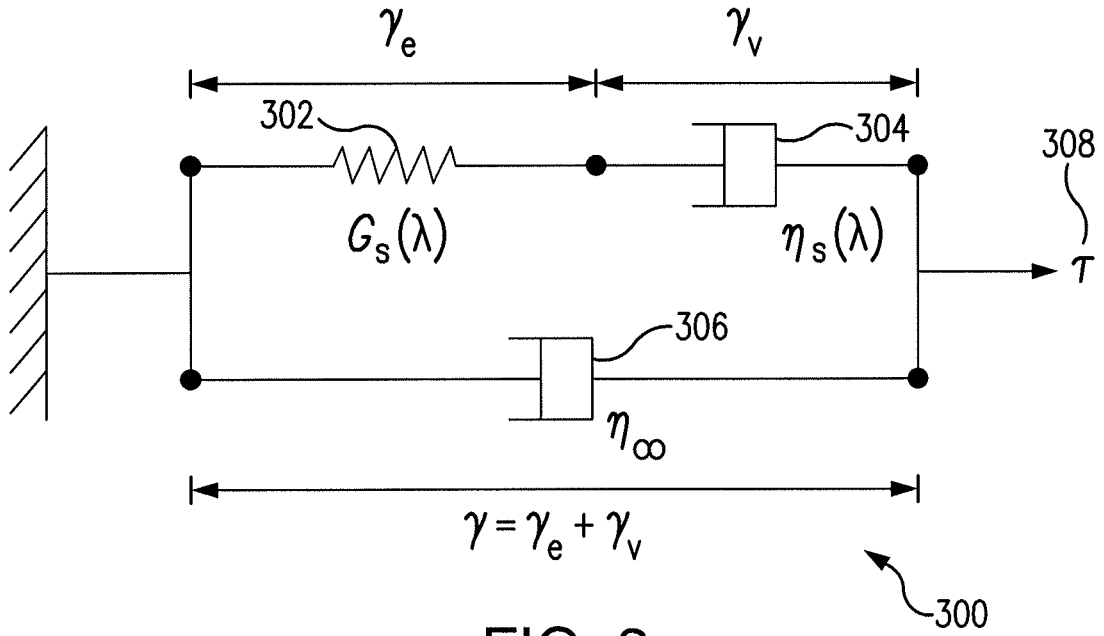
FIG. 3 illustrates a mechanical analog of a time-dependent rheological model.

FIG. 3 illustrates a mechanical analog 300 of a time-dependent rheological model. Mechanical analog 300 includes a structural elastic modulus 302, a structural viscosity function 304, a viscosity function 306, and a shear stress 308. Mechanical analog 300 may be used to describe the thixotropic, viscoelastic, and yielding behaviors of fracturing fluid 118. Mechanical analog 300 is described by two main equations: stress equation (14) and structure equation (19). In certain embodiments, the stress of fracturing fluid 118 may be calculated according to equation (14):

$$\dot{\tau} + \frac{\tau}{\theta_1(\lambda)} = \frac{\eta_\infty}{\theta_2(\lambda)}\dot{\gamma} + \eta_\infty\ddot{\gamma} \tag{14}$$

Wherein:

$\tau$ is the shear stress;

$\dot{\tau}$ is the shear stress rate;

$\lambda$ is the structure parameter of fracturing fluid 118;

$\theta_1(\lambda)$ is the relaxation time of fracturing fluid 118 for a given level of structure, $\lambda$;

$\theta_2(\lambda)$ is the retardation time of fracturing fluid 118 for a given level of structure, $\lambda$;

$\dot{\gamma}$ is the shear rate of fracturing fluid 118;

$\ddot{\gamma}$ is the derivative of the shear rate of fracturing fluid 118; and $\eta_\infty$ is the viscosity of fracturing fluid 118 in an unstructured state ($\lambda$=0).

The time-dependent rheological model of equation (14), may be solved by calculating the parameters of equations (15)-(18):

$$\theta_1(\lambda) = \left(\frac{\eta_v(\lambda)-\eta_\infty(\lambda)}{G_s(\lambda)}\right) \tag{15}$$

$$\theta_2(\lambda) = \left(1-\frac{\eta_\infty}{\eta_v(\lambda)}\right)\frac{\eta_\infty}{G_s(\lambda)} \tag{16}$$

$$G_s(\lambda) = G_0 e^{m\left(\frac{1}{\lambda}-\frac{1}{\lambda_0}\right)} \tag{17}$$

$$\eta_v(\lambda) = \eta_\infty e^{\lambda} \tag{18}$$

Wherein:

$\eta_v(\lambda)$ is the purely viscous character of the viscosity of fracturing fluid 118, represented by $\eta_s+\eta_\infty$;

$\eta_s$ is the structure viscosity function of fracturing fluid 118;

$G_s(\lambda)$ is structural elastic modulus of fracturing fluid 118;

$G_0$ is the structural elastic modulus of the completely structured fracturing fluid 118; and $\lambda_0$ is the structure parameter of the fully structured fracturing fluid 118.

In certain embodiments, a structure parameter of fracturing fluid 118 is calculated to further define how fracturing fluid 118 behaves in schematic model 200. In some embodiments, structure parameter, $\lambda$, describes the state of fracturing fluid 118. The evolution of structure parameter $\lambda$ may vary from 0 to 1, with 0 corresponding to a completely unstructured state and 1 corresponding to a completely structured state. In certain embodiments, equation (19) may be used to calculate structure parameter, $\lambda$:

$$\dot{\lambda} = \frac{1}{t_{eq}}\left[\left(\frac{1}{\lambda}-\frac{1}{\lambda_0}\right)^a - \left(\frac{\lambda}{\lambda_{eq}(\tau)}\right)^b\left(\frac{1}{\lambda_{eq}(\tau)}-\frac{1}{\lambda_0}\right)^a\dot{\gamma}\right] \tag{19}$$

Wherein:

$t_{eq}$ is the equilibrium time;

a, b are dimensionless positive constants;

$\dot{\lambda}$ is the time derivative of the structure parameter; and $\lambda_{eq}(\tau)$ is the equilibrium structure parameter of fracturing fluid 118 as a function of the shear stress.

Evolution equation (19), may be solved by calculating the parameters of equations (20) and (21):

$$\lambda_{eq}(\dot{\gamma}) = \ln\left(\frac{\eta_{eq}(\tau)}{\eta_\infty}\right) \tag{20}$$

$$\eta_{eq}(\dot{\gamma}) = \left(1 - e^{-\frac{\eta_0\dot{\gamma}}{\tau_0}}\right)\left(\frac{\tau_0 - \tau_{0d}}{\dot{\gamma}} e^{-\frac{\dot{\gamma}}{\dot{\gamma}_{0d}}} + \frac{\tau_{0d}}{\dot{\gamma}} + K\dot{\gamma}^{n-1}\right) + \eta_\infty \tag{21}$$

Wherein:

$\eta_{eq}$ ($\tau$) is the equilibrium viscosity as a function of fracturing fluid 118 shear stress;

$\lambda_{eq}(\dot{\gamma})$ is the equilibrium structure parameter of fracturing fluid 118 as a function of shear rate;

$\eta_0$ is the viscosity of fracturing fluid 118 in a fully structured state ($\lambda$=1);

$\tau_0$ is the static yield stress of fracturing fluid 118;

$\tau_{0d}$ is the dynamic yield stress of fracturing fluid 118;

n is the power-law index;

K is the consistency index; and $\eta_{eq}$ ($\dot{\gamma}$) is the equilibrium viscosity of fracturing fluid 118 as a function of the shear rate.

The shear rate required to calculate the mass and momentum balance equations can be estimated using equation (22):

$$\dot{\gamma} = \frac{4v_z}{D} \text{ or } \frac{4v_x}{d} \tag{22}$$

Thus, in certain embodiments, equations (1)-(22) may be used to calculate the pressure of fracturing fluid 118 at points along wellbore 114, vertical wellbore portion 115, and perforation section 116. Mass and momentum balance equations (2) and (3), respectively, are used to calculate how fracturing fluid 118 flows through wellbore cylinder 202. Mass and momentum balance equations (7) and (8), respectively, are used to calculate how fracturing fluid 118 and filtrate 120 flow through perforation cylinder 204. To provide a more accurate representation of how fracturing fluid 118 flows in schematic representation 200, the shear and normal stresses found in momentum equations (3) and (8) may be calculated using a time-dependent rheological model. In certain embodiments, mechanical analog 300 is used to describe the time-dependent rheological model, leading to stress equation (14) and structure equation (19) for fracturing fluid 118. The input to these equations may change by manipulating the properties of fracturing fluid 118, thereby changing the pressure of fracturing fluid 118 at points along perforation section 116. In certain embodiments, a first pressure of fracturing fluid 118 at surface 104 is used along with the rheological properties of fracturing fluid 118 to determine the pressure at points along perforation section 116. Once the stress of perforation section 116 is known, fracturing fluid 118 may be optimized to provide greater fracturing fluid 118 efficiency and pressure.

Once the pressure of fracturing fluid 118 is calculated at points along perforation section 116, and the stress of perforation section 116 is known, a ratio may be calculated. A ratio of the pressure of fracturing fluid 118 to the stress of perforation section 116 at points along perforation section 116 may be used to indicate whether the pressure of fracturing fluid 118 is sufficient to create-pressure induced fractures. In certain embodiments, if the ratio is greater than one at the points along perforation section 116, then there is a strong likelihood that the pressure of fracturing fluid 118 is sufficient to create pressure-induced fractures in perforation section 116.

However, in some embodiments, the calculated ratio may be less than one. If the ratio is less than one, the pressure of fracturing fluid 118 may not be high enough at points along the perforation section 116 to create pressure-induced fractures. Fracturing fluid 118 may then need to be manipulated to achieve a ratio greater than one. In certain embodiments, additives such biocides, breakers, diverting agents, friction reducer, surfactant, and gel stabilizers may be added to fracturing fluid 118. One or more of these additives may affect the rheological properties of fracturing fluid 118, resulting in a change in the pressure of fracturing fluid 118 at points along perforation section 116. In certain embodiments, the process of calculating the ratio and manipulating fracturing fluid 118 may be repeated as many times as necessary in order to obtain a desired ratio. One may manipulate one or more rheological variables of fracturing fluid 118 by adjusting one or more of the chemicals or substances of fracturing fluid 118. In this manner, an "optimized fracturing fluid" may be produced.

Once a desired ratio is achieved, the pumping energy required to induce fractures in the perforation using the optimized fracturing fluid is determined. Wellbore 114 may then be injected with the optimized fracturing fluid 118 at the determined pumping energy to create pressure-induced fractures in perforation section 116. In certain embodiments fracturing fluid 118 is manipulated in order to produce a ratio that results in the lowest pumping energy required to create pressure-induced fractures in perforation section 116. For example, determining that the lowest pumping energy required to fracture the at least one perforation may occur when the injection of the fracturing fluid occurs at the first pressure, $P_0$.

Modifications, additions, or omissions may be made to schematic representation 200 without departing from the scope of the disclosure. For example, schematic representation 200 may be used to model the behavior of fluids in two or three dimensions. In some embodiments, the ratio used to determine when to inject fracturing fluid 118 into wellbore 114 is done at a ratio other than one. In certain embodiments the fracturing fluid creates pressure induced fractures in perforation section 116 and in the reservoir surrounding perforation section 116. In certain embodiments, other rheological models may be used to capture the time-dependent elasto-viscoplastic behavior of fracturing fluid 118. As another example, schematic representation may include any number of perforations in any form or direction, which may in turn affect the equations used to model schematic representation 200.

Figure 4:
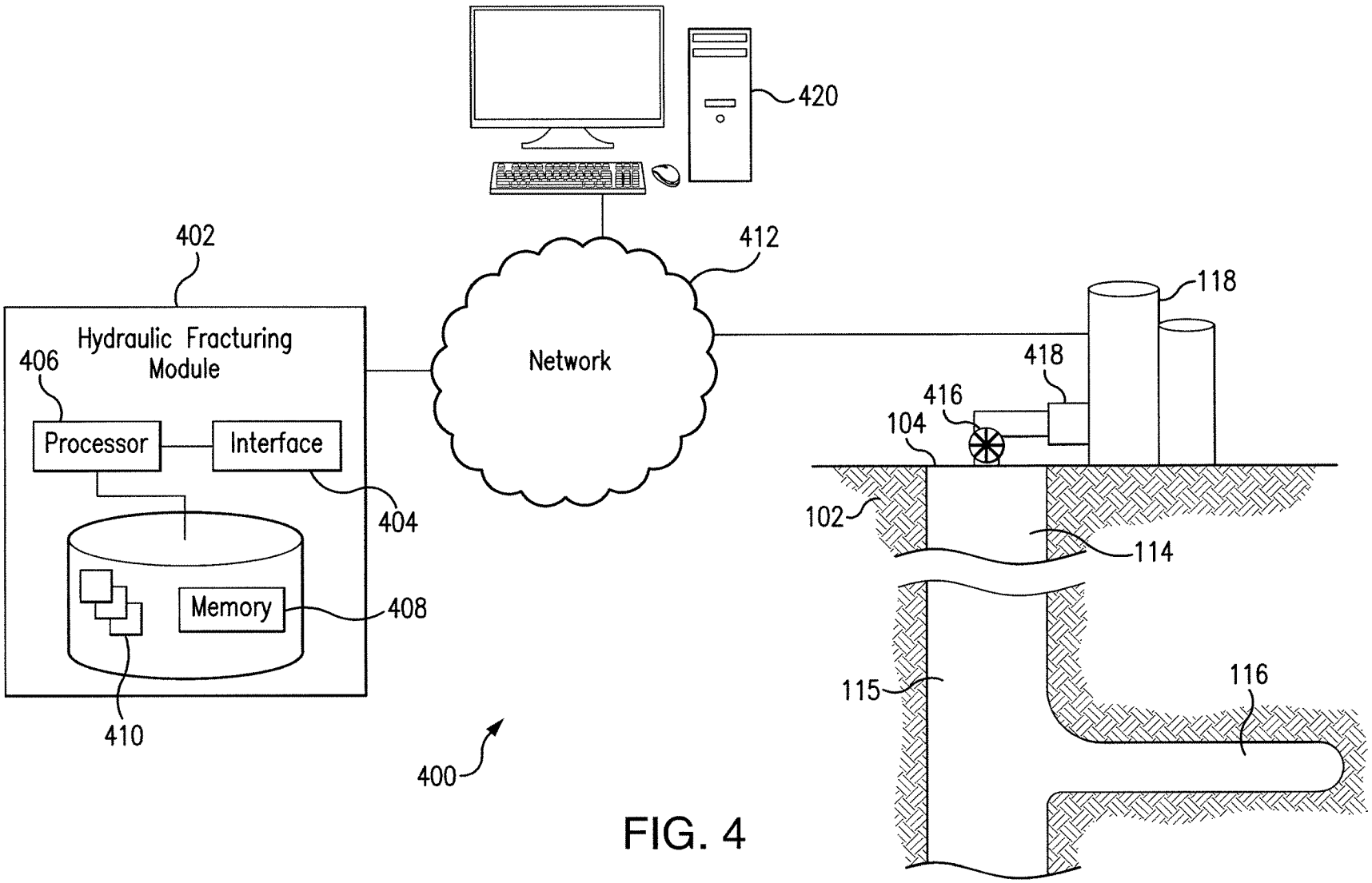
FIG. 4 is an example system for optimizing hydraulic fracturing.

FIG. 4 is an example system for optimizing hydraulic fracturing. System 400 includes a workstation 420, which communicates with a hydraulic fracturing module 402, an actuator 416, and a pump 418 over a network 412. Hydraulic fracturing module 402 includes an interface 404, a processor 406, and a memory 408. Memory 408 includes a fracturing program 410, which facilitates the optimization of hydraulic fracturing.

Workstation 420 enables a user to optimize the hydraulic fracturing process. Workstation 420 enables one or more users to monitor, administer, or otherwise interact with hydraulic fracturing module 402, actuator 416, and pump 418. Workstation 420 may include one or more laptops, personal computers, monitors, display devices, handheld devices, smartphones, servers, user input devices, or other suitable components for enabling user input. For example, workstation 420 may allow a user to access hydraulic fracturing module 402 and calculate the pressure of fracturing fluid 118 at points along perforation section 116. Workstation 420 may also allow a user to determine the rheological properties of fracturing fluid 118 based on the composition of fracturing fluid 118. For example, workstation 420 may access hydraulic fracturing module 402 and select a fracturing fluid 118 for a desired hydraulic fracturing job. A user may then select one or more additives to use with fracturing fluid 118 in order to optimize the efficiency of the fracturing fluid 118 during the hydraulic fracturing process. Based on fracturing fluid 118 and the chosen additives, workstation 420 may then be used to access hydraulic fracturing module 402 and calculate the pressure of fracturing fluid 118 at points along perforation section 116. In certain embodiments, workstation 420 and hydraulic fracturing module 402 may be integrated or may be the same device.

Network 412 represents any suitable network operable to facilitate communication between the components of system 400. Network 412 may include any interconnecting system capable of transmitting audio, video, signals, data, messages, or any combination of the preceding. Network 412 may include all or a portion of a public switched telephone network (PSTN), a public or private data network, a local area network (LAN), a metropolitan area network (MAN), a wide area network (WAN), a local, regional, or global communication or computer network such as the Internet, a wireline or wireless network, an enterprise intranet, or any other suitable communication link, including combinations thereof operable to facilitate communication between the components.

Hydraulic fracturing module 402 represents any suitable components that maintain information and perform processing relating to optimizing hydraulic fracturing. Hydraulic fracturing module 402 may include a network server, remote server, mainframe, host computer, workstation, web server, personal computer, file server, or any other suitable device operable to communicate with other devices and process data. In some embodiments, hydraulic fracturing module 402 may execute any suitable operating system such as IBM's zSeries/Operating System (z/OS), MS-DOS, PC-DOS, MAC-OS, WINDOWS, UNIX, OpenVMS, Linux, or any other appropriate operating systems, including future operating systems. The functions of hydraulic fracturing module 402 may be performed by any suitable combination of one or more servers or other components at one or more locations. In the embodiment where the modules are servers, the servers may be public or private servers, and each server may be a virtual or physical server. The server may include one or more servers at the same or at remote locations. Hydraulic fracturing module 402 may also include any suitable component that functions as a server.

In the illustrated embodiment, hydraulic fracturing module 402 includes interface 404, processor 406, and memory 408.

Interface 404, represents any suitable device operable to receive information from network 412, transmit information through network 412, perform suitable processing of the information, communicate to other devices, or any combination thereof. For example, interface 404 may receive from workstation 420 a selection of a fracturing fluid 118 and one or more additives to be used in hydraulic fracturing system 400. As another example, interface 404 may communicate with actuator 416 and pump 418 to inject fracturing fluid 118 into wellbore 114. In some embodiments, interface 404 may communicate the rate at which pump 418 injects fracturing fluid 118 into wellbore 114. In certain embodiments, the rate at which pump 418 injects fracturing fluid 118 into wellbore 114 is the lowest pumping energy required to create a pressure-induced fracture at a point along perforation section 116. Interface 404 represents any port or connection, real or virtual, including any suitable hardware and/or software, including protocol conversion and data processing capabilities, to communicate through a LAN, WAN, or other communication system that allows hydraulic fracturing module 402 to exchange information with network 412, actuator 416, pump 418, workstation 420, or any other components of system 400.

Processor 406 communicatively couples interface 404 and memory 408 while controlling the operation of hydraulic fracturing module 402. Processor 406 includes any hardware and/or software that operates to control and process information. For example, processor 406 may analyze fracturing fluid 118 and store its rheological properties in memory 408. In certain embodiments, processor 406 may use mass balance equations, momentum balance equations, and rheological models to calculate the pressure of fracturing fluid 118 at points along perforation section 116. As another example, workstation 420 may transmit data associated with the fracturing stress of perforation 116 to hydraulic fracturing module 402 to be stored in memory 408. Processor 406 may calculate a ratio of the pressure of fracturing fluid 118 to the stress of perforation section 116 at points along perforation section 116. Processor 406 may then determine that the ratio is greater than one and activate actuator 416 coupled to pump 418 and inject fracturing fluid 118 at a first pressure into wellbore 114 and through perforation section 116. Processor 406 may be a programmable logic device, a microcontroller, a microprocessor, any suitable processing device, or any suitable combination of the preceding.

Memory 408 stores, either permanently or temporarily, data, operational software, information for processor 406, other components of hydraulic fracturing module 402, or other components of system 400. Memory 408 includes any one or a combination of volatile or non-volatile local or remote devices suitable for storing information. For example, memory 408 may include random access memory (RAM), read only memory (ROM), flash memory, magnetic storage devices, optical storage devices, network storage devices, cloud storage devices, solid-state devices, or any other suitable information storage device or a combination of these devices. Memory 408 may store information in one or more databases, file systems, tree structures, any other suitable storage system, or any combination thereof. Furthermore, different information stored in memory 408 may use any of these storage systems (e.g., fracturing program 410 may be stored in a relational database). Moreover, any information stored in memory 408 may be encrypted or unencrypted, compressed or uncompressed, and static or editable. Although illustrated as including particular modules, memory 408 may include any suitable information for use in the operation of hydraulic fracturing module 402.

In the illustrated embodiment, memory 408 includes fracturing program 410. Fracturing program 410 may contain information associated with fracturing fluid 118, additives, fracture stress of subterranean formation 102, mass and momentum balance equations, and time-dependent rheological models that takes into account the elasticity, viscoplasticity, and structural development of fracturing fluid 118. For example, a user may run a number of tests on fracturing fluid 118 to determine properties associated with the fluid, such as the relaxation time of the fracturing fluid, the retardation time of the fracturing fluid, the steady-state viscosity of the fracturing fluid in an unstructured state, and the steady-state viscosity of the fracturing fluid in a structured state. Workstation 420 may then communicate with hydraulic fracturing module 402 and store the data associated with fracturing fluid 118 in fracturing program 410. As another example, fracturing program 410 may contain mass and momentum balance equations and time-dependent rheological models that aid in calculating the flow of fracturing fluid 118 into wellbore 114, through vertical wellbore portion 115 and into perforation section 116.

In an exemplary embodiment of operation, a plurality of points along perforation section 116 are determined. Workstation 420 communicates with hydraulic fracturing module 402 and calculates the pressure of fracturing fluid 118 at these points based on a first pressure and a time dependent rheological model that takes into account the fracturing fluid's elasticity, viscoplasticity, and structural development. Hydraulic fracturing module 402 calculates a ratio of the pressure of fracturing fluid 118 to the stress of perforation section 116 at the plurality of points along perforation section 116. Hydraulic fracturing module 402 may then determine that the ratio is greater than one, and activate actuator 416 coupled to pump 418, which injects fracturing fluid 118 into wellbore 114 at the first pressure.

A component of system 400 may include an interface, logic, memory, and other suitable elements. An interface receives input, sends output processes the input and/or output, and performs other suitable operations. An interface may comprise hardware and software. Logic performs the operation of the component. For example, logic executes instructions to generate output from input. Logic may include hardware, software and other logic. Logic may be encoded in one or more non-transitory, tangible media, such as a computer readable medium or any other suitable tangible medium, and may perform operations when executed by a computer. Certain logic, such as a processor, may manage the operation of a component. Examples of a processor include one or more computers, one or more microprocessors, one or more applications, and other logic.

Modifications, additions, or omissions may be made to system 400 without departing from the scope of the disclosure. For example, system 400 may optimize the hydraulic fracturing process different from or in addition to the ways described herein. For example, multiple hydraulic fracturing modules 402 may operate in parallel to facilitate the optimization process or be used to calculate the pressure of fracturing fluid 118 at points along perforation section 116. System 400 may include any number of subterranean formations 102, perforation sections 116, actuators 416, pumps 418, and workstations 420. Any suitable logic may perform the functions of system 400 and the components within system 400.

Figure 5:
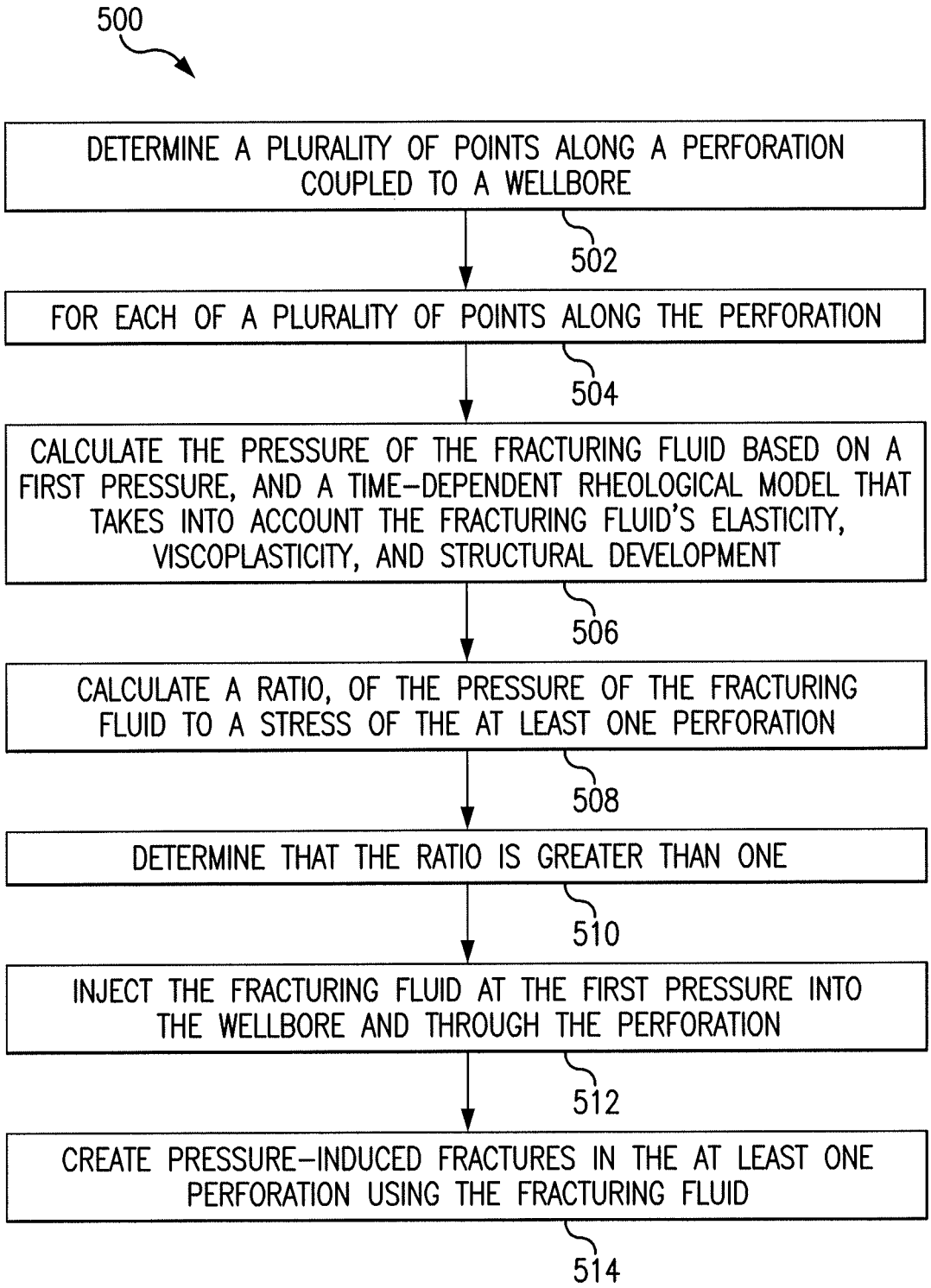
FIG. 5 is a flowchart that illustrates an example method of optimizing a hydraulic fracturing process.

FIG. 5 is a flowchart illustrating a method 500 of optimizing fracturing fluid 118. Hydraulic fracturing module 402 of system 400 may perform one or more steps of method 500. However, this disclosure also contemplates any element of system 400 such as workstation 420 performing a portion, or all of method 500. By performing method 500, hydraulic fracturing module 402 optimizes the fracturing fluid 118 used to create pressure-induced fractures in perforation 116.

At step 502 hydraulic fracturing module 402 determines a plurality of points along perforation section 116. For each of the plurality of points determined by fracturing module 402, steps 504 and 506 are completed. The plurality of points along perforation section 116 may represent a particular point along perforation section 116, the entire length of perforation section 116, or a number of points along perforation section 116.

At step 506, hydraulic fracturing module 402 calculates a pressure of fracturing fluid 118 based on a first pressure, $P_0$, and a time-dependent rheological model that takes into account the elasticity, viscoplasticity, and the structural development of fracturing fluid 118. The time-dependent rheological properties associated with fracturing fluid 118, such as elasticity, viscoplasticity, and structural development, may be stored in fracturing program 410. In certain embodiments, the time-dependent rheological properties of fracturing fluid 118 are determined using testing equipment such as a rheometer, with the results transmitted to hydraulic fracturing module 402 using workstation 420. The testing results may then be stored in fracturing program 410.

At step 508, hydraulic fracturing module 402 calculates a ratio of the pressure of fracturing fluid 118 to a stress of perforation section 116. In certain embodiments, hydraulic fracturing module 402 calculates the ratio of the pressure of fracturing fluid 118 at each of a plurality of points along perforation section 116 to the fracture stress at each of the plurality of points of perforation section 116. In some embodiments hydraulic fracturing module 402 uses mass and momentum balance equations based on schematic model 200 coupled to a time-dependent rheology equation modeled using mechanical analog 300 to determine the pressure of fracturing fluid 118 at points along perforation section 116.

At step 510, hydraulic fracturing module 402 determines that the ratio is greater than one at each of the plurality of points along perforation section 116. If the ratio is greater than one at the points along perforation section 116, then there is a strong likelihood that the pressure of fracturing fluid 118 is sufficient to create pressure-induced fractures in perforation section 116.

At step 512, fracturing fluid 118 is injected at the first pressure into wellbore 114 and through the at least one perforation section 116. At step 514 the injected fracturing fluid 118 creates pressure-induced fractures at the points in the at least one perforation 116. In certain embodiments, the energy at which pump 418 injects fracturing fluid 118 into wellbore 114 is the lowest pumping energy required to create a pressure-induced fracture at a point along perforation section 116.

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

The terms "couple" or "couples" as used herein are intended to mean either an indirect or a direct connection. Thus, if a first section couples to a second section, that connection may be through a direct connection, or through an indirect connection via other connections.

The present disclosure is therefore well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee.

What is claimed is:

1. A method for optimizing hydraulic fracturing in a subterranean formation having at least one perforation of a perforation cylinder extending from a wellbore, comprising:

calculating a first pressure of a fracturing fluid along a wellbore cylinder of the wellbore;

for each of a plurality of points along the perforation cylinder of the at least one perforation:

calculating a second pressure of the fracturing fluid based on the first pressure and a time-dependent rheological model that includes at least one of elasticity, viscoplasticity, and structural development of the fracturing fluid;

calculating a ratio of the second pressure of the fracturing fluid to a fracture stress of the at least one perforation;

determining that the ratio is greater than one at each of the plurality of points;

injecting the fracturing fluid at the first pressure into the wellbore and through the at least one perforation; and creating pressure-induced fractures in the at least one perforation using the fracturing fluid.

2. The method of claim 1, wherein calculating the first pressure and the second pressure of the fracturing fluid comprises calculating the first pressure and the second pressure according to a mass balance model, a momentum balance model, and a time-dependent rheology model.

3. The method of claim 2, wherein the time-dependent rheology model used to calculate the first pressure of the fracturing fluid includes a plurality of variables selected from the group consisting of: relaxation time of the fracturing fluid; retardation time of the fracturing fluid; viscosity of the fracturing fluid in an unstructured state; viscosity of the fracturing fluid in a structured state; structural viscosity of the fracturing fluid; equilibrium viscosity of the fracturing fluid; shear stress of the fracturing fluid; static yield stress of the fracturing fluid; dynamic yield stress of the fracturing fluid; shear rate of the fracturing fluid; shear rate that marks the transition in stress from static yield stress to dynamic yield stress; structure parameter of the fracturing fluid; structural parameter of the fracturing fluid in structured and unstructured state; structural elastic modulus of the fracturing fluid; structural elastic modulus of the fracturing fluid in an fully structured state; positive dimensionless constants; power—law index; and equilibrium time.

4. The method of claim 1, wherein injecting the fracturing fluid further comprises:

determining that a lowest pumping energy required to fracture the at least one perforation occurs when the injection of the fracturing fluid occurs at the first pressure.

5. The method of claim 1, further comprising:

calculating the stress for each of the plurality of points along the at least one perforation, wherein a plurality of properties of the at least one perforation used to calculate the stress are selected from the group consisting of: permeability; capillary pressure; swelling capacity; perforation dimensions; and any combinations thereof.

6. The method of claim 1, wherein the time-dependent rheological model includes the elasticity, viscoplasticity, and structural development of the fracturing fluid.

7. The method of claim 1, wherein creating pressure-induced fractures further comprises creating pressure-induced fractures in a reservoir surrounding the at least one perforation.

8. A method for optimizing hydraulic fracturing in a subterranean formation having at least one perforation of a perforation cylinder extending from a wellbore, comprising:

calculating a first pressure of a fracturing fluid along a wellbore cylinder of the wellbore;

calculating a second pressure of the fracturing fluid at a point along the at least one perforation, wherein the calculation is based on the first pressure and a time-dependent rheological model that includes one of elasticity, viscoplasticity, and structural development of the fracturing fluid;

calculating a ratio of the pressure of the fracturing fluid to a fracture stress at the point along the at least one perforation;

determining that the ratio is greater than one and injecting the fracturing fluid at the first pressure into the wellbore and through the at least one perforation; and creating pressure-induced fractures in the perforation using the fracturing fluid.

9. The method of claim 8, wherein calculating the first pressure and the second pressure of the fracturing fluid comprises calculating the first pressure and the second pressure according to a mass balance model, a momentum balance model, and a time-dependent rheology model.

10. The method of claim 9, wherein the time-dependent rheology model used to calculate the first pressure of the fracturing fluid includes a plurality of variables selected from the group consisting of: relaxation time of the fracturing fluid; retardation time of the fracturing fluid; viscosity of the fracturing fluid in an unstructured state; viscosity of the fracturing fluid in a structured state; structural viscosity of the fracturing fluid; equilibrium viscosity of the fracturing fluid; shear stress of the fracturing fluid ; static yield stress of the fracturing fluid; dynamic yield stress of the fracturing fluid; shear rate of the fracturing fluid; shear rate that marks the transition in stress from static yield stress to dynamic yield stress; structure parameter of the fracturing fluid; structural parameter of the fracturing fluid in structured and unstructured state; structural elastic modulus of the fracturing fluid; structural elastic modulus of the fracturing fluid in an fully structured state; positive dimensionless constants; power—law index; and equilibrium time.

11. The method of claim 8, wherein injecting the fracturing fluid further comprises:

determining that a lowest pumping energy required to fracture the at least one perforation occurs when the injection of the fracturing fluid occurs at the first pressure.

12. The method of claim 8, further comprising:

calculating the fracture stress at the point along the at least one perforation, wherein a plurality of properties of the at least one perforation used to calculate the fracture stress are selected from the group consisting of: permeability; capillary pressure; swelling capacity; perforation dimensions; and any combinations thereof.

13. The method of claim 8, wherein the time-dependent rheological model includes the elasticity, viscoplasticity, and structural development of the fracturing fluid.

14. The method of claim 8, wherein the fracturing fluid comprises a cross-linked fluid and a proppant.

15. Non-transitory computer readable storage medium comprising logic, the logic operable, when executed by a processor, to:

for each of a plurality of points along an at least one perforation of a perforation cylinder extending from a wellbore:

calculating a first pressure of a fracturing fluid along a wellbore cylinder of the wellbore;

calculate a second pressure of the fracturing fluid based on the first pressure and a time-dependent rheological model that includes at least one of elasticity, viscoplasticity, and structural development of the fracturing fluid;

calculate a ratio of the second pressure of the fracturing fluid to a fracture stress of the at least one perforation;

determine that the ratio is greater than one at each of the plurality of points; and activate an actuator coupled to a pump that injects the fracturing fluid at the first pressure into the wellbore and through the at least one perforation.

16. The non-transitory computer readable storage medium of claim 15, wherein the first pressure and the second pressure of the fracturing fluid is calculated according to a mass balance model, a momentum balance model, and a time-dependent rheology model.

17. The non-transitory computer readable storage medium of claim 16, wherein the time-dependent rheology model used to determine the first pressure of the fracturing fluid includes a plurality of variables selected from the group consisting of: relaxation time of the fracturing fluid; retardation time of the fracturing fluid; viscosity of the fracturing fluid in an unstructured state; viscosity of the fracturing fluid in a structured state; structural viscosity of the fracturing fluid; equilibrium viscosity of the fracturing fluid; shear stress of the fracturing fluid; static yield stress of the fracturing fluid; dynamic yield stress of the fracturing fluid; shear rate of the fracturing fluid; shear rate that marks the transition in stress from static yield stress to dynamic yield stress; structure parameter of the fracturing fluid; structural parameter of the fracturing fluid in structured and unstructured state; structural elastic modulus of the fracturing fluid; structural elastic modulus of the fracturing fluid in an fully structured state; positive dimensionless constants; power—law index; and equilibrium time.

18. The non-transitory computer readable storage medium of claim 15, wherein injecting the fracturing fluid further comprises:

determining that a lowest pumping energy required to fracture the at least one perforation occurs when the injection of the fracturing fluid occurs at the first pressure.

19. The non-transitory computer readable storage medium of claim 15, further comprising:

calculating the fracture stress of the at least one perforation, wherein the properties of the at least one perforation used to calculate the stress are selected from the group consisting of: permeability; capillary pressure; swelling capacity; perforation dimensions; and any combinations thereof.

20. The non-transitory computer readable storage medium of claim 15, wherein the time-dependent rheological model includes elasticity, viscoplasticity, and structural development of the fracturing fluid.

* * * * *